United States Patent [19]

Uchida et al.

[11] Patent Number: 4,741,714

[45] Date of Patent: May 3, 1988

[54] SUPPORTING DEVICE FOR MARINE PROPULSION APPARATUS

[75] Inventors: Tatsuki Uchida; Masanori Takahashi, both of Hamamatsu, Japan

[73] Assignee: Sanshin Kogyo Kabushiki Kaisha, Hamamatsu, Japan

[21] Appl. No.: 19,885

[22] Filed: Feb. 27, 1987

[30] Foreign Application Priority Data

Mar. 5, 1986 [JP] Japan ..... 61-47877

[51] Int. Cl.[4] ..... B63H 5/12

[52] U.S. Cl. ..... 440/66; 440/900

[58] Field of Search ..... 440/66, 1, 70, 53, 61, 440/900; 248/641, 642, 643; 114/285, 288

[56] References Cited

U.S. PATENT DOCUMENTS

| | | | |
|---|---|---|---|
| 885,370 | 4/1908 | Palmer et al. | 440/66 |
| 1,553,160 | 9/1925 | Hickman | 440/66 |
| 1,827,806 | 10/1931 | Aitken | 440/66 |
| 2,713,843 | 7/1955 | Staley | 248/641 |
| 2,764,119 | 9/1956 | Sigle | 248/641 |
| 2,886,462 | 5/1959 | Jagiel | 248/641 |
| 3,075,490 | 11/1959 | Lang | 248/641 |
| 3,469,557 | 9/1969 | Wollard | 440/69 |
| 3,768,432 | 10/1973 | Spaulding | 440/53 |
| 4,384,856 | 5/1983 | Hall et al. | 248/642 |
| 4,449,945 | 5/1984 | Ferguson | 440/53 |
| 4,657,513 | 4/1987 | Baker | 440/66 |

FOREIGN PATENT DOCUMENTS

| | | | |
|---|---|---|---|
| 608128 | 9/1960 | Italy | 440/69 |

*Primary Examiner*—Joseph F. Peters, Jr.
*Assistant Examiner*—Edwin L. Swinehart
*Attorney, Agent, or Firm*—Ernest A. Beutler

[57] ABSTRACT

An improved outrigger type supporting arrangement for an outboard drive that further includes a baffle plate for redirecting water downwardly and away from the supporting arrangement when traveling at low speeds. The baffle plate is configured so as to direct the water flow downwardly and under the splash plate of the outboard drive during slow speed running conditions.

4 Claims, 2 Drawing Sheets

SUPPORTING DEVICE FOR MARINE PROPULSION APPARATUS

BACKGROUND OF THE INVENTION

This invention relates to a supporting device for a marine propulsion apparatus and more particularly to a device for protecting the supporting mechanism from water and for redirecting the water flow at the rear of the watercraft so as to avoid splashing.

In many watercraft, the outboard drive, be it either an outboard motor or the outboard drive portion of an inboard/outboard drive, is mounted in close proximity to the transom of the watercraft. Although such mounting arrangements have a number of advantages, there are times when it is desirable to mount the outboard drive at a relatively rearwardly spaced location from the transom. Such rear mounting of the outboard drive shifts the center of gravity rearwardly and permits the bow to operate in a more raised position so as to reduce the water resistance and improve the high speed performance. Also, such a mounting arrangement can improve the thrust transmission to the watercraft.

A wide variety of outrigger type supports have been proposed for accomplishing such a mounting. Although these outrigger type mountings are very useful in achieving their desired purpose, certain problems can result. For example, when operating under certain running conditions and particularly under slow speeds, the operation of the hull and transom on the water causes the water to flow upwardly along the transom and can impinge upon the supporting mechanism. Of course, it is desirable to protect the supporting mechanism from the intrusion of water, particularly when the supporting mechanism includes a tilt and trim arrangement for adjusting the tilt and trim positioning of the outboard drive.

Furthermore, the outboard drive normally includes a splash plate for precluding the propeller from splashing water onto the supporting mechanism and also from splashing this water into the watercraft. However, when the aforedescribed condition exists, the splash plate is not capable of performing its intended function.

It is, therefore, a principal object of this invention to provide an improved supporting device for a marine propulsion apparatus.

It is a further object of this invention to provide an outrigger type supporting arrangement for an outboard drive wherein the outboard drive supporting mechanism is protected from water splashes under all running conditions.

It is a further object of this invention to provide an improved supporting arrangement for a marine outboard drive wherein the supporting mechanism is protected from the water.

SUMMARY OF THE INVENTION

This invention is adapted to be embodied in a marine propulsion device for a watercraft that has a transom, an outboard drive unit carrying propulsion means for powering the watercraft, and support means for supporting the outboard drive unit rearwardly of the transom and in spaced relationship thereto. In accordance with this invention, a baffle plate is adapted to be fixed relative to the transom and extends rearwardly therefrom for directing water flow away from the support means.

DETAILED DESCRIPTION OF THE PREFERRED EMBDODIMENT

Figure 1:
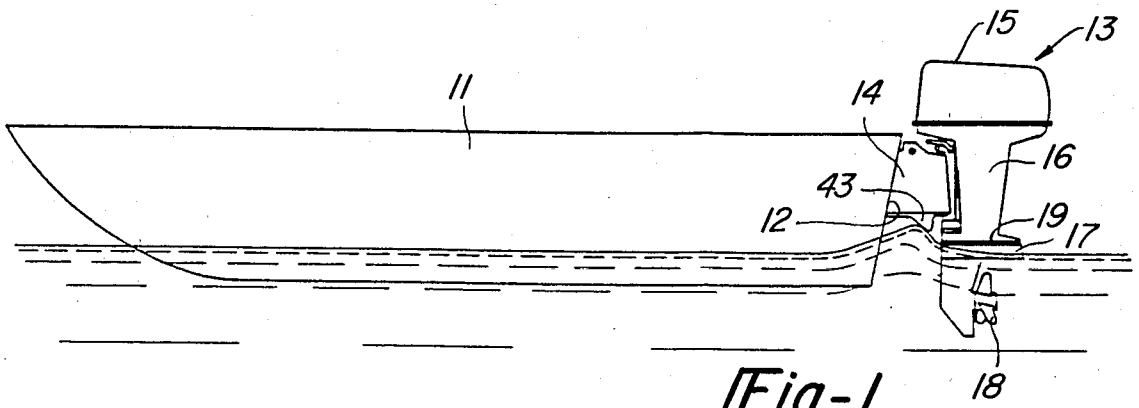
FIG. 1 is a side elevational view of a watercraft constructed in accordance with an embodiment of the invention.

In the drawings, the reference numeral 11 indicates a hull of a watercraft. The watercraft hull 11 may be of any known type and includes a transom 12 from which an outboard drive unit, indicated generally by the reference numeral 13, is supported by means of a supporting assembly, indicated generally by the reference numeral 14. In accordance with the invention, the supporting assembly 14 is designed so as to support the outboard drive unit 13 in a rearwardly spaced position relative to the transom 12 so as to provide a generally rearwardly disposed center of gravity.

In the illustrated embodiment, the outboard drive unit 13 comprises an outboard motor that includes a power head assembly 15 which is comprised of an internal combustion engine and surrounding protective cowling. Depending from the power head 15 is a drive shaft housing 16 in which a drive shaft (not shown) is journaled in a known manner. The drive shaft is rotatably driven by the internal combusion engine of the power head 15 and extends into a lower unit 17. The lower unit 17 includes a forwad, neutral, reverse transmission (not shown) that drives a propeller 18 in a known manner. The lower unit 17 further includes a splash plate 19 that extends from the forward end of the lower unit 17 rearwardly and terminates rearwardly of the propeller 18.

A steering shaft 21 is affixed to the drive shaft housing 16 by means of an upper support 22 and a lower support 23. The steering shaft 21 is, in turn, journaled within a swivel bracket 24 for steering of the outboard motor 13 about a generally vertically extending steering axis defined by the steering shaft 21.

The supporting mechanism 14 includes a pair of first upper links 25 that have rearwardly pivotal connections by means of pivot pins 26 to the upper end of the swivel bracket 24. The forward ends of the links 25 are pivotally connected by means of pivot pins 27 to a pair of side brackets 28 which are, in turn, affixed in a suitable manner to the transom 12. In addition, there are provided a pair of lower links 29 that are pivotally connected at their rearward ends by means of pivot pins 31 to a lower portion of the swivel bracket 24. The forward ends of the lower links 29 are pivotally connected by means of pivot pins 32 to the side plates 28.

A trim fluid motor 33 has a trim rod 34 that is affixed to an internal piston (not shown) and which has its extended end connected to the pivot pin 31. The housing of the trim fluid motor 33 is connected by means of a pivot pin 35 to the lower end of a link 36. The link 36 is, in turn, pivotally carried by the pivot pin 32 and is normally held in engagement with a first stop 37 by the thrust force and weight of the outboard drive unit 13.

A tilt fluid motor 38 is provided with a piston rod 39 that is affixed to a piston (not shown) of the tilt fluid motor 38. An extending end of the piston rod 39 is connected to one or both of the links 25 by means of a pivot pin 41. The housing of the tilt fluid motor 38 is connected to the side plates 28 by means of a pivot pin 42.

Figure 2:
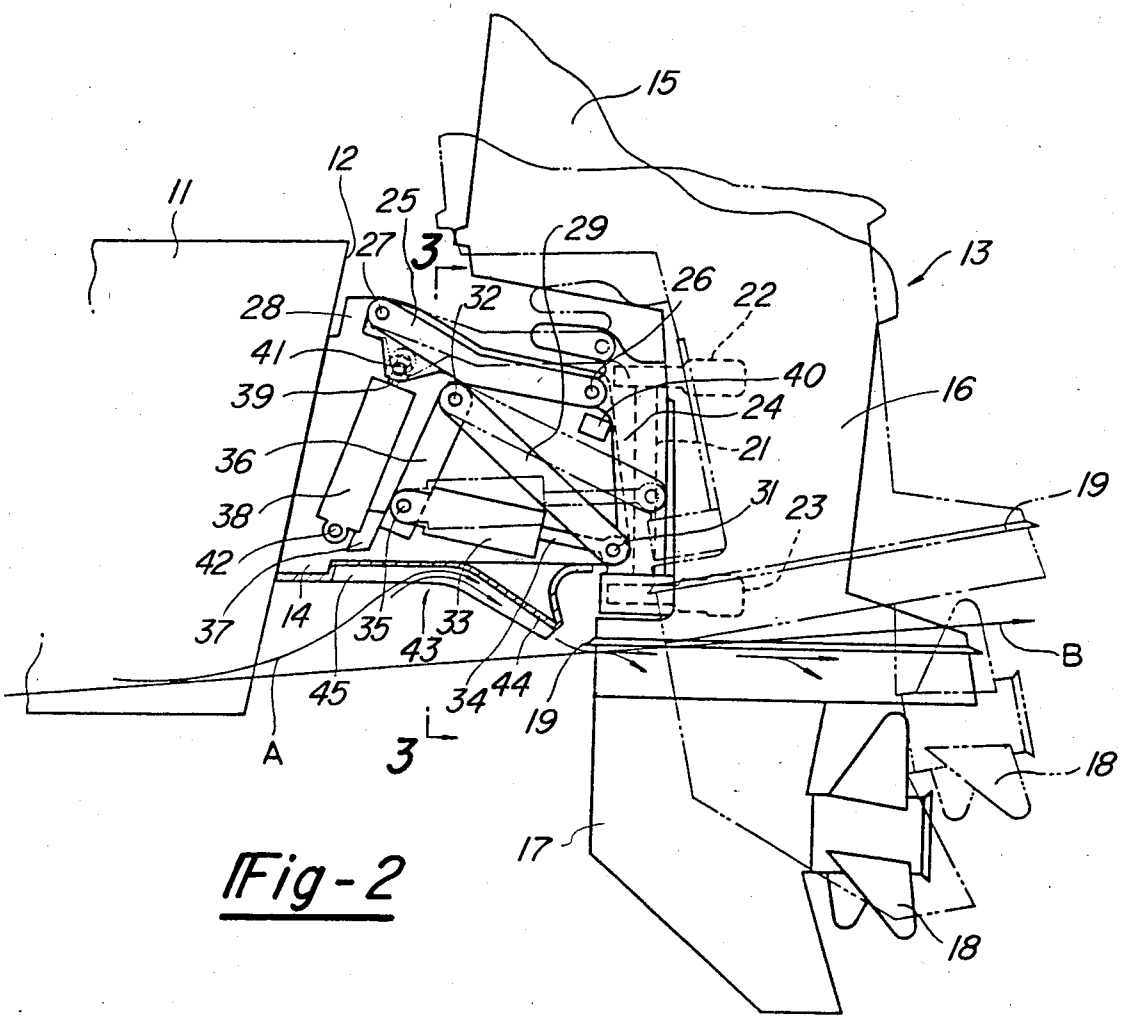
FIG. 2 is an enlarged side elevational view showing the rear portion of the watercraft, the outboard drive and the supporting unit for the outboard drive.

FIG. 2 shows the outboard motor 13 in its normal, fully trimmed down condition. To achieve trim operation, the fluid motors 33 and 38 are pressurized simultaneously so as to pivot the links 29 and 25 so as to effect trim pivotal movement of the outboard drive unit 13. The full range of trim movement is determined by the length of stroke of the trim fluid motor 33 and the phantom line view of FIG. 2 shows the fully trimmed up position.

To tilt up the outboard motor 13 from the fully trimmed up condition, the trim fluid motor 38 is continuously energized. During this movement, the links 25 will pivot about the pivot pins 27. However, since the trim fluid motor 35 is at the end of its stroke, the links 29 will pivot about the pivot pin 32 and the link 36 will pivot so as to permit the trim fluid motor 33 to continue to move without restricting the tilting movement of the outboard drive. This movement continues until the link 36 contacts a stop 40. This construction is best shown in Japanese Application Serial No. 61-65187, filed Mar. 24, 1986 and corresponding copending U.S. application Ser. No. 028,896, filed Mar. 23, 1987, in the name of Tatsuki Uchida et al, entitled Supporting Device For Marine Propulsion Apparatus, and assigned to the same assignee of this application which disclosure is incorporated herein by reference.

During noraml high speed cruising operation, the water deflected from under the hull of the watercraft 11 and rearwardly of the transom 12 will follow the line indicated by the arrow B in FIG. 2 and will impinge upon the underside of the splash plate 19 for redirection downwardly away from the supporting unit 14 and the outboard motor 13 toward the propeller 18. Hence, there is good protection under this running condition.

When running at low speeds, however, the water tends to flow upwardly along the rear surface of the transom 12 as shown by the arrow A in FIG. 2. Under this condition, the water can impinge upon the supporting mechanism 12 and this is obviously an undesirable condition. In addition, the splash plate 19 will be effectively bypassed and it will not be able to perform its intended function.

Figure 3:
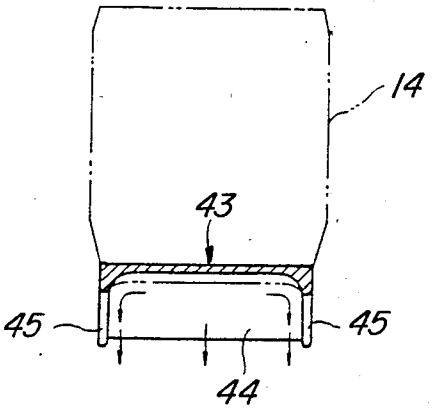
FIG. 3 is a cross-sectional view taken along the line 3—3 of FIG. 2.

In order to protect the supporting mechanism 14 and to redirect the water flow toward the underside of the splash plate 19 under these circumstances, there is provided a baffle plate, indicated generally by the reference numeral 43. The baffle plate 43 extends transversely between the side plates 28 and has a first generally horizontally extending portion that is joined by a curved section to a downwardly directed portion 44 which terminates adjacent the forward end of the underside of the splash plate 19 when the outboard motor 13 is in its fully trimmed down position. In addition, there are provided a pair of depending side flanges 45 that extend through the full length of the baffle plate 43 so as to provide containment of the water flowing along the line A as shown in FIGS. 2 and 3. Hence, rather than splashing upwardly on the supporting mechanism 14, the water is redirected downwardly underneath the splash plate 19 so that this plate will redirect the water flow downwardly and toward the propeller 18. Hence, a very simple and yet highly effective arrangement is provided for insuring against damage to the supporting unit by water impingement and further to insure efficient operation of the splash plate 19.

Although an embodiment of the invention has been illustrated and described, it is to be understood that various changes and modifications may be made without departing from the spirit and scope of the invention, as defined by the appended claims.

We claim:

1. In a marine propulsion device for a watercraft having a hull terminating in a transom, an outboard drive unit carrying propulsion means for powering said watercraft and a splash plate positioned above said propulsion means, and support means for supporting said outboard drive unit for tilt and trim movement rearwardly of said transom and in spaced relationship thereto, said hull and said support means being related so that movement of the hull through the water at speed causes water to be deflected upwardly of said splash plate and toward said supporting means, the improvement comprising a baffle adapted to be fixed relative to said transom and extending rearwardly therefrom for directing water flow away from said support means and toward the underside of said splash plate.

2. In a marine propulsion device as set forth in claim 1 wherein the outboard drive unit is comprised of a propeller.

3. In a marine propulsion device as set forth in claim 2 wherein the baffle extends in a generally horizontal direction and further includes a pair of downwardly depending side flanges for containing the water splashed thereagainst between said side flanges.

4. In a marine propulsion device as set forth in claim 3 wherein the baffle has a generally horizontally extending portion extending rearwardly from the transom and terminates in a downwardly inclined portion directed toward the underside of the splash plate.

* * * * *